US005143655A

United States Patent [19]

Chiu et al.

[11] Patent Number: 5,143,655

[45] Date of Patent: Sep. 1, 1992

[54] EFFICIENTLY PACKAGED HUMIDIFIER DEVICE

[75] Inventors: Bernard Chiu, Ashland, Mass.; Jui-Shang Wang, Taipei, Taiwan; Frank Marino, Upton, Mass.

[73] Assignee: Duracraft Corporation, Sudbury, Mass.

[21] Appl. No.: 726,677

[22] Filed: Jul. 8, 1991

[51] Int. Cl.[5] ..... B01F 3/04

[52] U.S. Cl. ..... 261/24; 261/107

[58] Field of Search ..... 261/107, 99, 104, 24, 261/29, DIG. 4

[56] References Cited

U.S. PATENT DOCUMENTS

| | | | |
|---|---|---|---|
| 2,032,634 | 3/1936 | Ross | 261/107 |
| 2,054,200 | 9/1936 | Langford | 261/107 |
| 2,384,016 | 9/1945 | Dishner | 261/99 |
| 2,752,124 | 6/1956 | Nofziger | 261/29 |
| 2,774,581 | 12/1956 | Bowersox | 261/99 |
| 2,934,022 | 4/1960 | Rodick et al. | 261/29 |
| 2,998,714 | 9/1961 | Bonzer | 261/DIG. 4 |
| 3,045,450 | 7/1962 | Chandler | 261/104 |
| 3,290,021 | 12/1966 | Blachly et al. | 261/29 |
| 3,290,022 | 12/1966 | Brown, Jr. et al. | 261/29 |
| 3,787,036 | 1/1974 | Hastings | 261/29 |
| 3,802,493 | 4/1974 | Goettl | 261/24 |
| 4,351,781 | 9/1982 | Blatter | 261/29 |
| 4,698,188 | 10/1987 | Gutmann | 261/107 |
| 4,970,876 | 11/1990 | Vinokurov | 261/107 |
| 5,034,162 | 7/1991 | Chiu | 261/107 |
| 5,061,405 | 10/1991 | Stanek et al. | 261/104 |

FOREIGN PATENT DOCUMENTS

| | | | |
|---|---|---|---|
| 1261072 | 4/1961 | France | 261/107 |
| 3507544 | 9/1986 | France | 261/99 |

*Primary Examiner*—Tim Miles

*Attorney, Agent, or Firm*—John E. Toupal; Harold G. Jarcho

[57] ABSTRACT

A humidifier including a base defining a reservoir adapted to retain a liquid volume; the base having an open top and a horizontal cross section including a substantially rectangular portion, and a substantially circular portion intersecting and projecting into the rectangular portion; and the base including a substantially circular sidewall forming the circular portion, a substantially rectalinear endwall, a first substantially rectalinear sidewall extending between the circular sidewall and one end of the endwall, and a second substantially rectalinear sidewall extending between the circular sidewall and an opposite end of the endwall; the first sidewall, the second sidewall and the endwall forming the rectangular portion. The humidifier also includes an inlet wall defining an air inlet; a blower assembly demountably supported by the base and covering the open top; the blower assembly comprising an upper wall defining an air outlet disposed above the circular portion, a fan blade disposed between the circular portion and the air outlet, and an electrical motor coupled to the fan blade; and a wick retained by the base in the rectangular portion and comprising a source portion disposed in the reservoir and an evaporative portion disposed thereabove and between the air inlet and the fan blade, the wick adapted to provide liquid flow by capillary action from the source portion to the evaporative portion.

19 Claims, 3 Drawing Sheets

EFFICIENTLY PACKAGED HUMIDIFIER DEVICE

BACKGROUND OF THE INVENTION

This invention relates generally to a humidifier and, more particularly, to a portable humidifier intended for domestic and industrial use.

Various types of products are used to increase the level of the humidity in an enclosed environment. With respect to portable humidifying appliances, they may be broken down broadly into two categories, one being the evaporation type and the other being the steam vaporizer type. One well known type of evaporative humidifier employs one wick element that produces by capillary action liquid flow from a reservoir to a wick portion disposed in a path of airflow produced by an electrical blower. Air moving through the wick element evaporates its water content producing vapor that is dispersed into the surrounding environment to increase the humidification level thereof.

Wick type humidifiers offer the advantages of low cost, and relatively trouble free, clean operation. However, a need exists for portable wick type humidifiers with increased output/volume ratios, that is, the ratio of between the vapor output and external dimensions of a particular humidifier unit.

The object of this invention, therefore, is to provide an evaporative humidifier device exhibiting an improved, output/volume ratio.

SUMMARY OF THE INVENTION

The invention is a humidifier including a base defining a reservoir adapted to retain a liquid volume; the base having an open top and a horizontal cross section including a substantially rectangular portion, and a substantially circular portion intersecting and projection into the rectangular portion; and the base including a substantially circular sidewall forming the circular portion, a substantially rectilinear endwall, a first substantially rectilinear sidewall extending between the circular sidewall and one end of the endwall, and a second substantially rectilinear sidewall extending between the circular sidewall and an opposite end of the endwall; the first sidewall, the second sidewall and the endwall forming the rectangular portion. The humidifier also includes an inlet wall defining an air inlet; a blower assembly demountably supported by the base and covering the open top; the blower assembly comprising an upper wall defining an air outlet disposed above the circular portion, a fan blade disposed between the circular portion and the air outlet, and an electrical motor coupled to the fan blade; and a wick retained by the base in the rectangular portion and comprising a source portion disposed in the reservoir and an evaporative portion disposed thereabove and between the air inlet and the fan blade, the wick adapted to provide liquid flow by capillary action from the source portion to the evaporative portion. The circular and rectangular portions optimize the output/volume of the humidifier.

According to specific features of the invention, the inlet wall is vertically aligned with and above the endwall; and the wick is disposed adjacent to and substantially parallel to the inlet wall and the endwall, and is substantially coextensive therewith. These features further enhance the output/volume ratio of the humidifier.

According to other features of the invention, the endwall and inlet wall are formed by a single common wall, and the air inlet extends between opposite vertical edges of the inlet wall. These features simplify fabrication of the humidifier and maximize air input.

According to another feature, the invention includes a rotatable air deflector supported by the upper wall in the air outlet. The rotatable air deflector facilitates selective control of the humidifiers air discharge pattern.

According to yet another feature, the humidifier includes a filter disposed between the air inlet and the evaporative portion of the wick. The filter prevents clogging of the wick element.

According to a further feature of the invention, the base comprises a stop disposed centrally within the circular sidewall and projecting upwardly to a desired maximum level of the liquid volume. The stop prevents inadvertent submersion of the blower assembly in the liquid volume.

According to additional features of the invention, the base defines handle portions projecting into the reservoir and positioned at a desired maximum level of the liquid volume. The handle portions serve the dual functions of handles for transporting the humidifier and indicators for a desired liquid fill level.

DESCRIPTION OF THE DRAWINGS

These and other objects and features of the invention will become more apparent upon a perusal of the following description taken in conjunction with the accompanying drawings wherein.

DESCRIPTION OF PREFERRED EMBODIMENT

Figure 1:
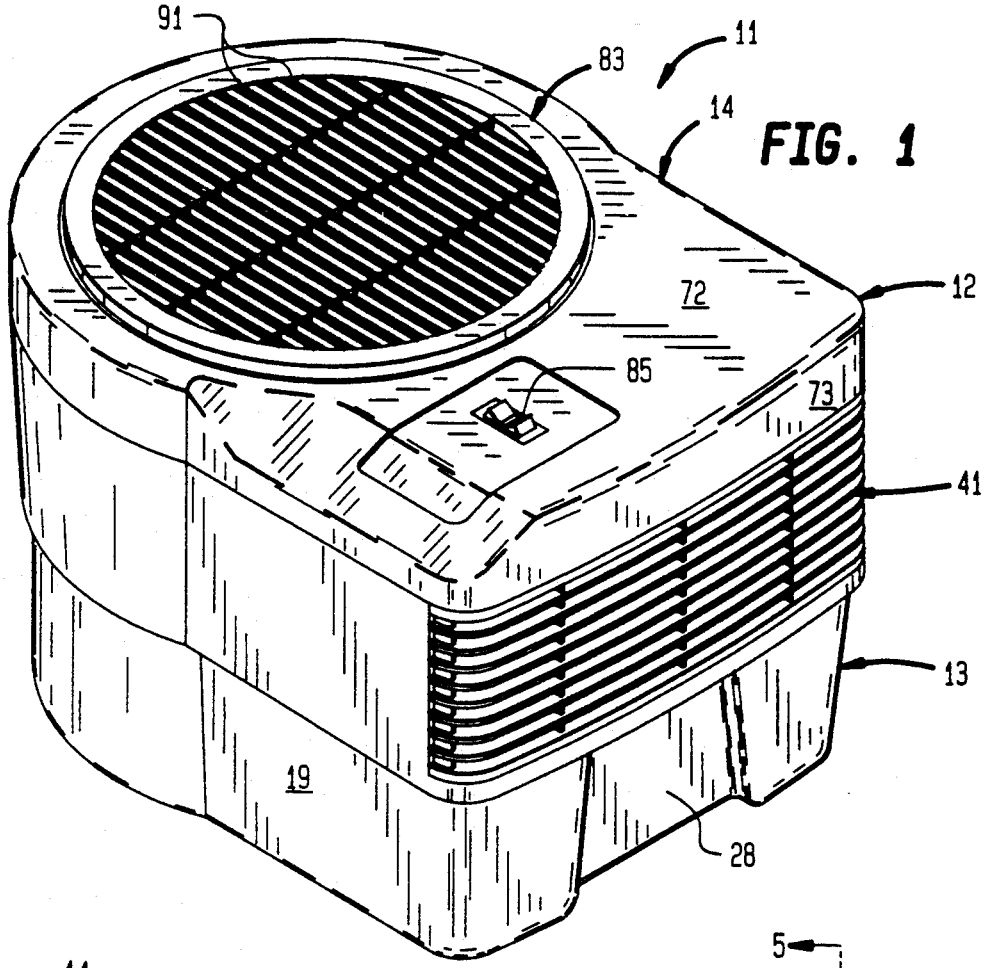
FIG. 1 is a perspective view of the humidifier according to the invention.

An evaporative humidifier 11 includes a housing 12 including a base 13 and a blower assembly cover 14. Forming the base 13 is a bottom wall 15, a circular sidewall 16, a common wall 17, a first sidewall 18 extending between one end of the common wall 17 and the circular sidewall 16 and a second sidewall 19 extending between an opposite side of the common wall 17 and the circular sidewall 16. The base 13 has an open top 21 and a lower internal portion thereof defines a reservoir 22 adapted to retain a liquid volume to a maximum level L. Projecting upwardly from the bottom wall 15 centrally within the circular sidewall 16 is a cylindrical stop 25 that terminates at the level L.

A recess 26 in a lower middle portion of the circular sidewall 16 defines a downwardly projecting handle surface 27 aligned with the level L. Formed in the common wall 17 opposite to the recess 26 is another recess 28 defining a downwardly projecting handle surface 29 also aligned with the liquid level L. A cartridge well 31 is formed in the bottom wall 15 and extends between the first and second sidewalls 18, 19. Forming the common wall 17 is a lower endwall portion 35 thereof and a vertically aligned upper inlet wall portion 36. A plurality of spaced apart ribs 39 extending between opposite edges of the inlet wall portion 36 define an air inlet 41. Projecting inwardly from an upper portion of the first sidewall 18 and adjacent to the inlet 41 are a pair of parallel, vertically oriented ridges 43, 44 that define a slot 45. A similar slot (not shown) is formed in the sidewall 19.

Figure 3:
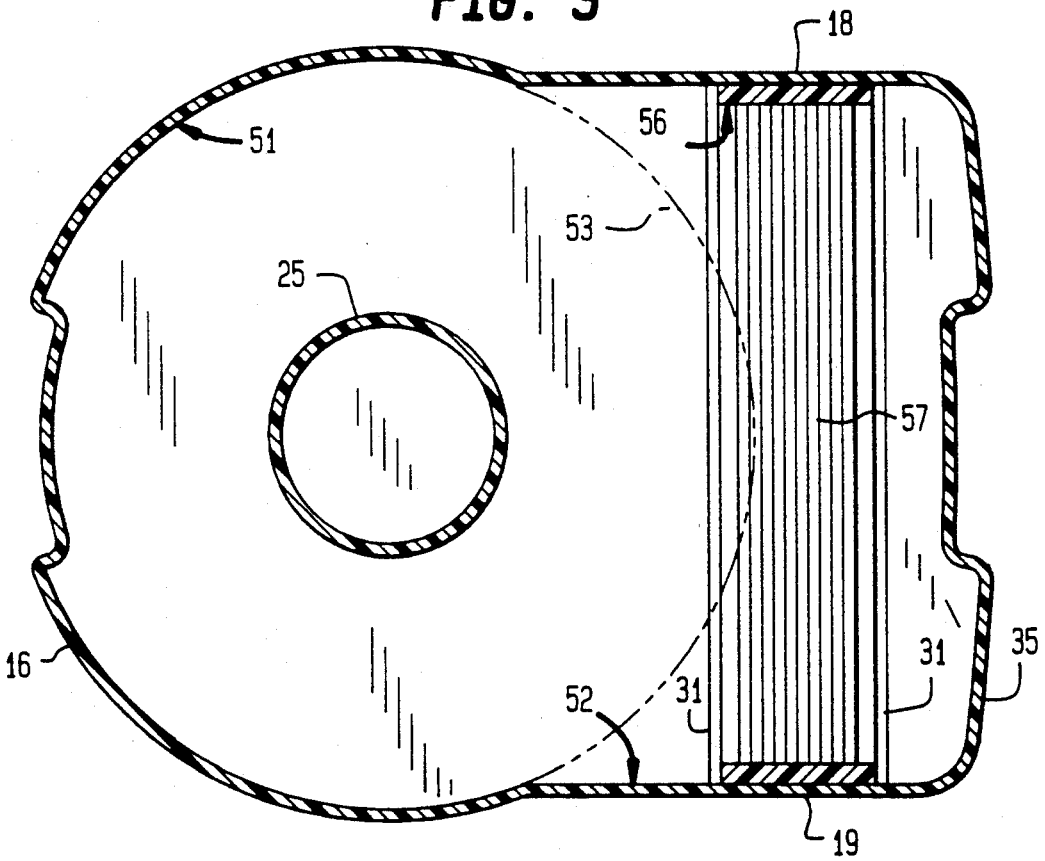
FIG. 3 is a cross sectional view taken along lines 3—3 of FIG. 4.

As shown in FIG. 3, the base 13 has a cross section that includes a circular portion 51 formed by the circular sidewall 16, and a rectangular portion 52 formed by the endwall 35, the first sidewall 18 and the second sidewall 19. The circular portion 51 intersects and projects into the rectangular portion 52 as shown by a phantom, dashed line 53. Preferably, the base 13 is an integrally molded unit.

Retained by the base 13 within the well 31 is a cartridge 55 including a frame 56 and a plurality of wick elements 57 retained thereby. The wick elements 57 have lower source portions 61 disposed in the reservoir 22 and upper evaporative portions 62 disposed above the reservoir 22 adjacent to the air inlet 41 in the inlet wall 36. Forming the wick element 57 is a conventional absorbent material that produces by capillary action a flow of liquid from the source portions 61 submerged in the water liquid volume within the reservoir 22 upwardly to the evaporative portions 62. An air filter 65 is retained between the slot 45 on the first sidewall 18 and a similar slot (not shown) on the second sidewall 19 and separates the evaporative portions 62 of the wick elements 57 from the air inlet 41.

The blower assembly 14 includes a cover 71 having an upper horizontal wall 72 and a skirt portion 73 projecting downwardly therefrom. The skirt portion 73 engages and conforms to the open top edge 21 of the base 13. Formed in the upper wall 72 is a circular air outlet opening 75. A blower enclosure 76 includes a cylindrical sidewall 77 projecting downwardly from the outlet opening 75 and a bottom wall 78 defining air passages 79. Preferably, the upper wall 72, the skirt portion 73 and the blower enclosure 76 are an integrally molded unit.

Figure 2:
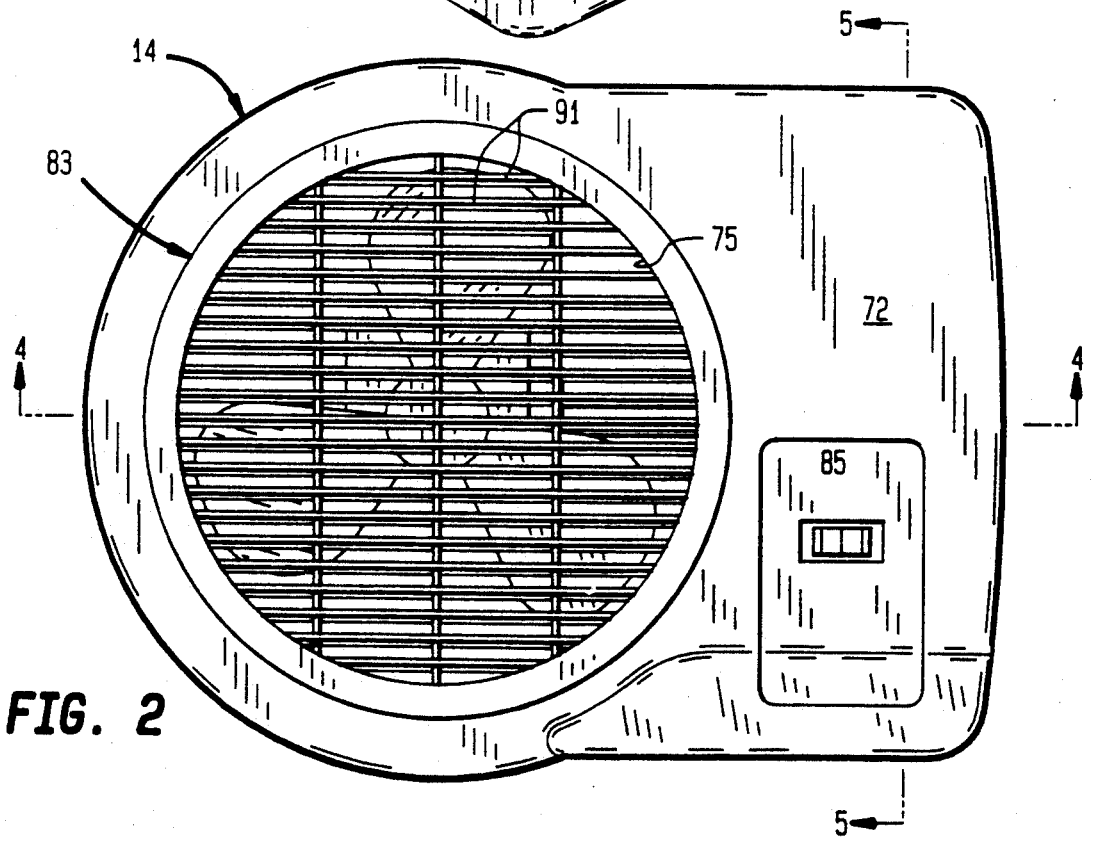
FIG. 2 is a top view of the humidifier shown in FIG. 1.
Figure 4:
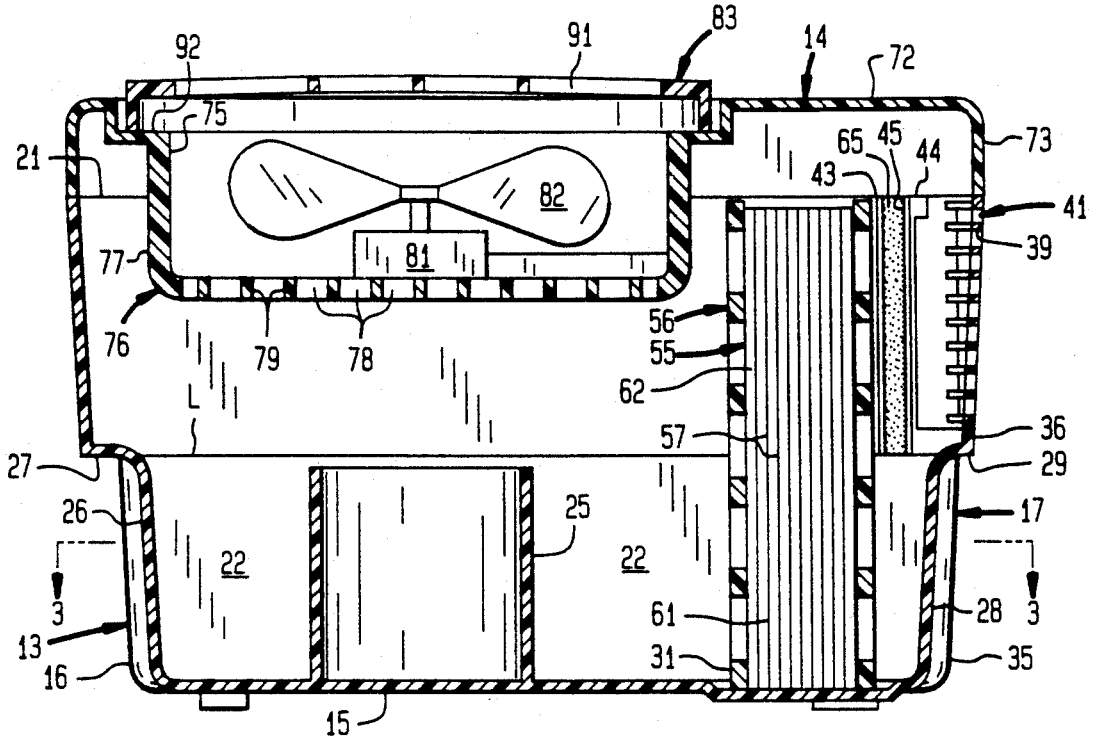
FIG. 4 is a cross sectional view taken along lines 4—4 of FIG. 2.
Figure 5:
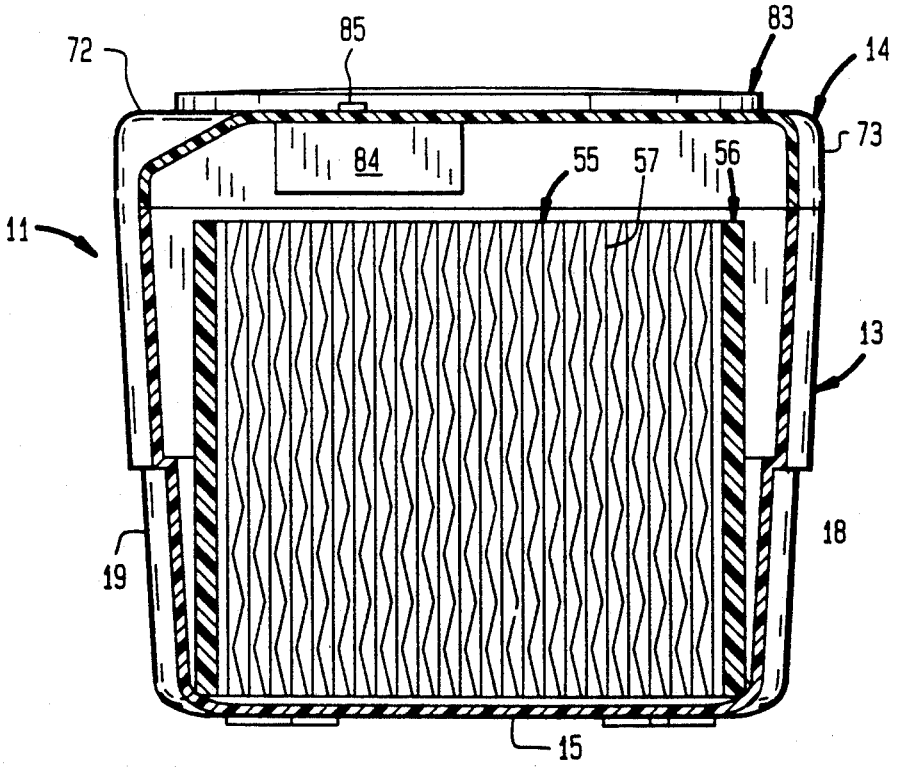
FIG. 5 is a cross sectional view taken along lines 5—5 of FIG. 2.

Also included in the blower assembly 14 are an electrical motor 81, a fan blade 82, a circular deflector plate 83 and electrical controls 84 including an electrical switch 85. The fan blade 82 is rotatably coupled to the motor 81 which is retained within the blower enclosure 76. As shown in FIGS. 2 and 4, the fan blade 82 and the air outlet 75 are positioned directly above the circular portion 51 of the base 13 and are arranged concentrically therewith. The circular deflector plate 83 including inclined deflector vanes 91 is rotatably mounted on a circular shoulder portion 92 connecting the upper wall 72 to the cylindrical sidewall 77 of the blower enclosure 76.

OPERATION

Prior to use of the humidifier 11, the blower assembly 14 is removed from the base 13 and the reservoir 22 is filled to the level L with a suitable liquid such as water. The recessed handle surfaces 27, 29 function as visible indicators of the desired maximum liquid level. After filling of the reservoir 22, the blower assembly 14 is replaced on the base 13 and the humidifier device 11 is positioned in an area in which humidification is desired.

Actuation of the electrical switch 85 energizes the electrical motor 81 to produce rotation of the fan blade 82. The rotating fan blade 82 draws air in through the air inlet 41 for discharge through the deflector plate 83. Included in the air flow path between the inlet 41 and the outlet 75 are the air filter 65, the evapororative portion 62 of the wick elements 57 and the passages 79 in the bottom wall 78 of the blower enclosure 76. Air passing through the evaporative portions 62 produces evaporation of its liquid content and the resultant vapor is entrained in the air flow for discharge into the surrounding environment through the air outlet 75. Selection of a desired discharge pattern is obtained by appropriate rotation of the deflector plate 83 on the shoulder portion 92 of the blower enclosure 76. The filter 65 removes dust particles in the air flowing between the inlet 41 and the wick cartridge 55 to thereby prevent clogging that would reduce the efficiency of the evaporative portions 62 of the wick elements 57.

Obviously, many modifications and variations of the present invention are possible in light of the above teachings. It is to be understood, therefore, that the invention can be practiced otherwise than as specifically described.

What is claimed is:

1. A humidifier comprising:

a base defining a reservoir adapted to retain a liquid volume; said base having an open top and a horizontal cross section including a substantially rectangular portion, and a substantially circular portion intersecting and projecting into said rectangular portion; and said base comprising a substantially circular sidewall forming said circular portion, a substantially rectilinear endwall, a first substantially rectilinear sidewall extending between said circular sidewall and one end of said endwall, and a second substantially rectilinear sidewall extending between said circular sidewall and an opposite end of said endwall; said first sidewall, said second sidewall and said endwall forming said rectangular portion;

an inlet wall defining an air inlet;

a blower assembly demountably supported by said base and covering said open top; said blower assembly comprising an upper wall defining an air outlet disposed above said circular portion, a fan blade disposed between said circular portion and said air outlet, and an electrical motor coupled to said fan blade; and wick means retained by said base in said rectangular portion, said wick means comprising a source portion disposed in said reservoir and an evaporative portion disposed thereabove and between said air inlet and said fan blade, said wick means adapted to provide liquid flow by capillary action from said source portion to said evaporative portion.

2. A humidifier according to claim 1 wherein said inlet wall is vertically aligned with and above said endwall.

3. A humidifier according to claim 2 wherein said wick means is disposed adjacent to and substantially parallel to said inlet wall and said endwall.

4. A humidifier according to claim 3 wherein said wick means is substantially co-extensive with said inlet wall and said endwall.

5. A humidifier according to claim 4 wherein said endwall and said inlet wall are formed by a single common wall.

6. A humidifier according to claim 5 wherein said air inlet extends between opposite vertical edges of said inlet wall.

7. A humidifier according to claim 5 including a rotatable air deflector supported by said upper wall in said air outlet.

8. A humidifier according to claim 5 including air filter means disposed between said air inlet and said evaporative portion of said wick means.

9. A humidifier according to claim 5 wherein said base comprises stop means disposed centrally within said circular sidewall and projecting upwardly to a desired maximum level of the liquid volume.

10. A humidifier according to claim 5 wherein said base defines recessed handle portions projecting into said reservoir and positioned at a desired maximum level of the liquid volume.

11. A humidifier according to claim 5 wherein said blower assembly includes electrical control means for activating said electrical motor.

12. A humidifier according to claim 1 wherein said air inlet extends between opposite vertical edges of said inlet wall.

13. A humidifier according to claim 1 including a rotatable air deflector supported by said upper wall in said air outlet.

14. A humidifier according to claim 1 including air filter means disposed between said air inlet and said evaporative portion of said wick means.

15. A humidifier according to claim 1 wherein said base comprises stop means disposed centrally within said circular sidewall and projecting upwardly to a desired maximum level of the liquid volume.

16. A humidifier according to claim 1 wherein said base defines recessed handle portions projecting into said reservoir and positioned at a desired maximum level of the liquid volume.

17. A humidifier according to claim 1 wherein said blower assembly includes electrical control means for activating said electrical motor.

18. Humidifier apparatus comprising:

a unitary, integrally molded base defining stop means and a reservoir adapted to retain liquid at a given maximum level, said stop means projecting into a central portion of said reservoir;

a humidification unit removably mounted on said base in a normal orientation above said reservoir and retaining electrically energized humidifier means for producing dispersion of liquid retained in said reservoir, said unit in the absence of said stop means being shaped and arranged to permit reorientation into a positive wherein portion of said electrically energized humidifier means would be disposed in said reservoir below said given maximum level, and wherein said stop means is arranged to prevent said reorientation of said unit into any positions wherein any portion of said electrically energized humidifier means is below said given level.

19. A humidifier according to claim 18 wherein said stop means is a hollow tube projecting up into said reservoir from a bottom surface of said base means.

* * * * *

UNITED STATES PATENT AND TRADEMARK OFFICE

CERTIFICATE OF CORRECTION

PATENT NO. : 5,143,655

DATED : September 1, 1992

INVENTOR(S) : Chiu, et al

It is certified that error appears in the above-indentified patent and that said Letters Patent is hereby corrected as shown below:

Column 6, line 17, cancel "positive" and substitute therefor --position--.

Signed and Sealed this

Sixth Day of September, 1994

*Attest:*

*Attesting Officer*

BRUCE LEHMAN

*Commissioner of Patents and Trademarks*